US006671980B1

(12) United States Patent
Liu

(10) Patent No.: US 6,671,980 B1
(45) Date of Patent: Jan. 6, 2004

(54) EASY-TO-WEAR FOOTWEAR

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 10 days.

(21) Appl. No.: 10/195,376

(22) Filed: Jul. 16, 2002

(51) Int. Cl.[7] ..... A43C 11/00
(52) U.S. Cl. ..... 36/50.1; 24/712; 24/713
(58) Field of Search ..... 36/50.1, 50.5, 36/88; 24/712.1–712.9, 713, 713.1–713.9, 712

(56) References Cited

U.S. PATENT DOCUMENTS 3,200,458 A * 8/1965 Marzocchi ..... 24/71 SK
5,230,171 A * 7/1993 Cardaropoli ..... 36/50.1
5,353,483 A * 10/1994 Louviere ..... 24/712.1
5,469,640 A * 11/1995 Nichols ..... 36/50.1
5,537,763 A * 7/1996 Donnadieu et al. ..... 36/50.1
6,032,387 A * 3/2000 Johnson ..... 36/50.1
6,351,897 B1 * 3/2002 Smith ..... 36/50.1
6,467,194 B1 * 10/2002 Johnson ..... 36/50.1
6,568,104 B2 * 5/2003 Liu ..... 36/50.1
2003/0150135 A1 * 8/2003 Liu ..... 36/50.1

* cited by examiner

*Primary Examiner*—M. D. Patterson
(74) *Attorney, Agent, or Firm*—Foley & Lardner

(57) ABSTRACT

An anchoring assembly on a footwear includes a stationary member, a pivotable member, a pivot unit, and a releasable fastener unit. The pivot unit is provided on the stationary and pivotable members to permit pivoting movement of the pivotable member relative to the stationary member between a footwear tightening position and a footwear loosening position. The releasable fastener unit is provided on the stationary and pivotable members for releasably retaining the pivotable member at the footwear tightening position. The releasable fastener unit includes a positioning member, a first fastener member mounted to the positioning member, a second fastener member provided on the pivotable member and fastened releasably to the first fastener member, and a resilient member for urging the first fastener member to engage releasably the second fastener member.

15 Claims, 12 Drawing Sheets

EASY-TO-WEAR FOOTWEAR

BACKGROUND OF THE INVENTION

1. Field of the Invention

The invention relates to a footwear, more particularly to a footwear which is easy to wear and remove.

2. Description of the Related Art

In co-pending U.S. patent application Ser. No. 10/137,902, the applicant disclosed an anchoring assembly on a footwear body. The anchoring assembly includes a stationary member, a pivotable member, a pivot unit and a releasable fastener unit. The stationary member is fixed on the footwear body. The pivotable member is provided with a footwear lace stringing part that is formed with at least one eyelet. The pivot unit is provided on the stationary and pivotable members to permit pivoting movement of the pivotable member relative to the stationary member about a pivot axis between a footwear tightening position and a footwear loosening position. The releasable fastener unit is provided on the stationary and pivotable members and releasably retains the pivotable member at the footwear tightening position.

SUMMARY OF THE INVENTION

The object of the present invention is to provide a footwear which is easy to wear and remove and which has fasteners that can prevent undesired loosening.

The footwear according to this invention includes a sole, an upper, a closure member, and an anchoring assembly.

The upper is connected to the sole, and has a toe portion and a heel portion. The upper is formed with an opening adjacent to the heel portion to permit slipping of a foot into the upper. The upper further has a tongue that is connected to the toe portion and that extends in a longitudinal direction, and first and second closure tabs that are spaced apart from each other in a transverse direction transverse to the longitudinal direction and that are disposed to overlap opposite lateral sides of the tongue, respectively.

The closure member is provided on the upper, extends between the first and second closure tabs, and is connected to at least one of the first and second closure tabs. The closure member is movable from a loosening state, where the closure member allows limited movement of the first and second closure tabs away from each other, to a tightened state, where the closure member pulls the first and second closure tabs toward each other to tighten the shoe around the foot.

The anchoring assembly includes a stationary member, a movable member, and a releasable fastener unit.

The stationary member is mounted securely on the second closure tab, whereas the movable member is connected to the closure member and is movable relative to the stationary member between a footwear tightening position, in which the closure member is moved to the tightened state, and a footwear loosening position, in which the closure member is moved to the loosening state.

The releasable fastener unit is provided on the stationary and movable members for releasably retaining the movable member at the footwear tightening position. The releasable fastener unit includes a positioning member provided on the stationary member, a first fastener member mounted movably on the positioning member, a second fastener member provided on the movable member and fastened releasably to the first fastener member, and a resilient member for urging the first fastener member away from the positioning member.

The first fastener member is movable relative to the second fastener member between an engaging position, where the first and second fastener members engage each other to retain the movable member at the footwear tightening position, and a disengaging position, where the first and second fastener members disengage from each other to permit movement of the movable member to the footwear loosening position.

The first fastener member includes a fastening portion fastened releasably to the second fastener member, and a pulling portion opposite to the fastening portion.

The anchoring assembly further includes a pull string unit. The pull string unit includes a string coupled to the pulling portion of the first fastener member and one of the sole and the upper. The string is operable so as to move the first fastener member to the disengaging position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
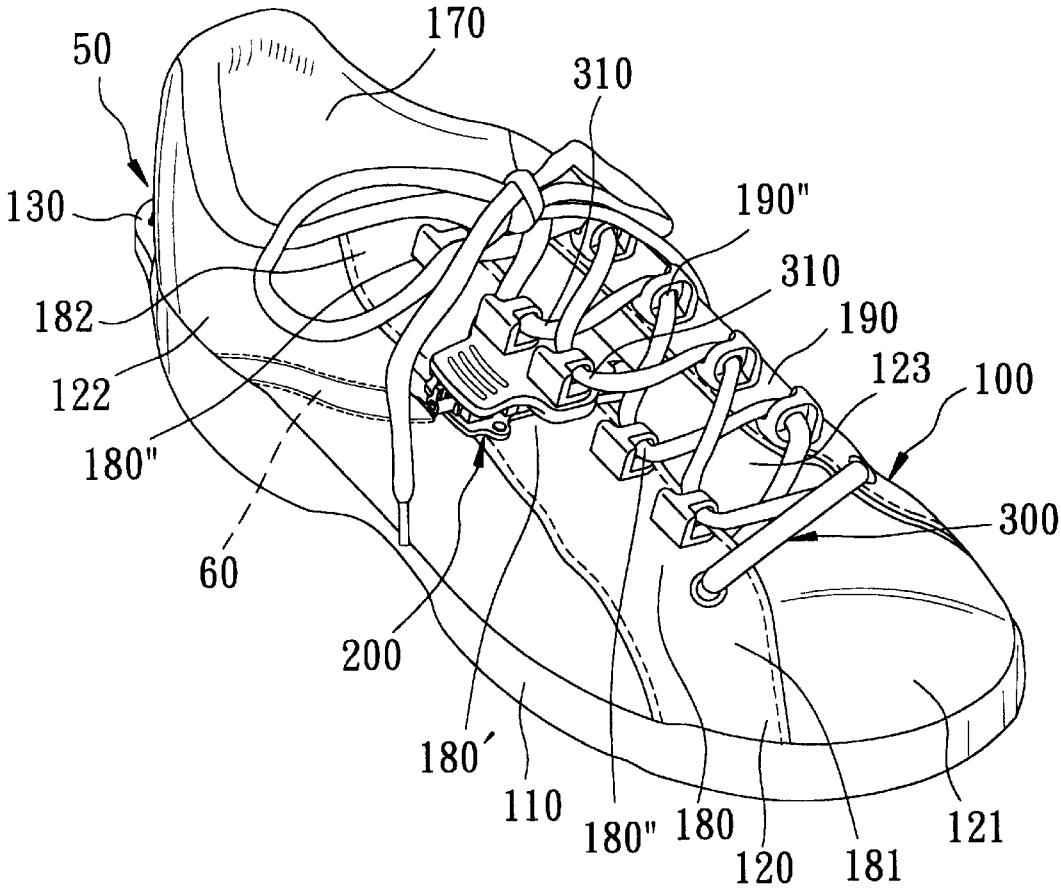
FIG. 1 is a perspective view of the first preferred embodiment of a footwear according to this invention, showing a closure member thereof in a tightened state.
Figure 2:
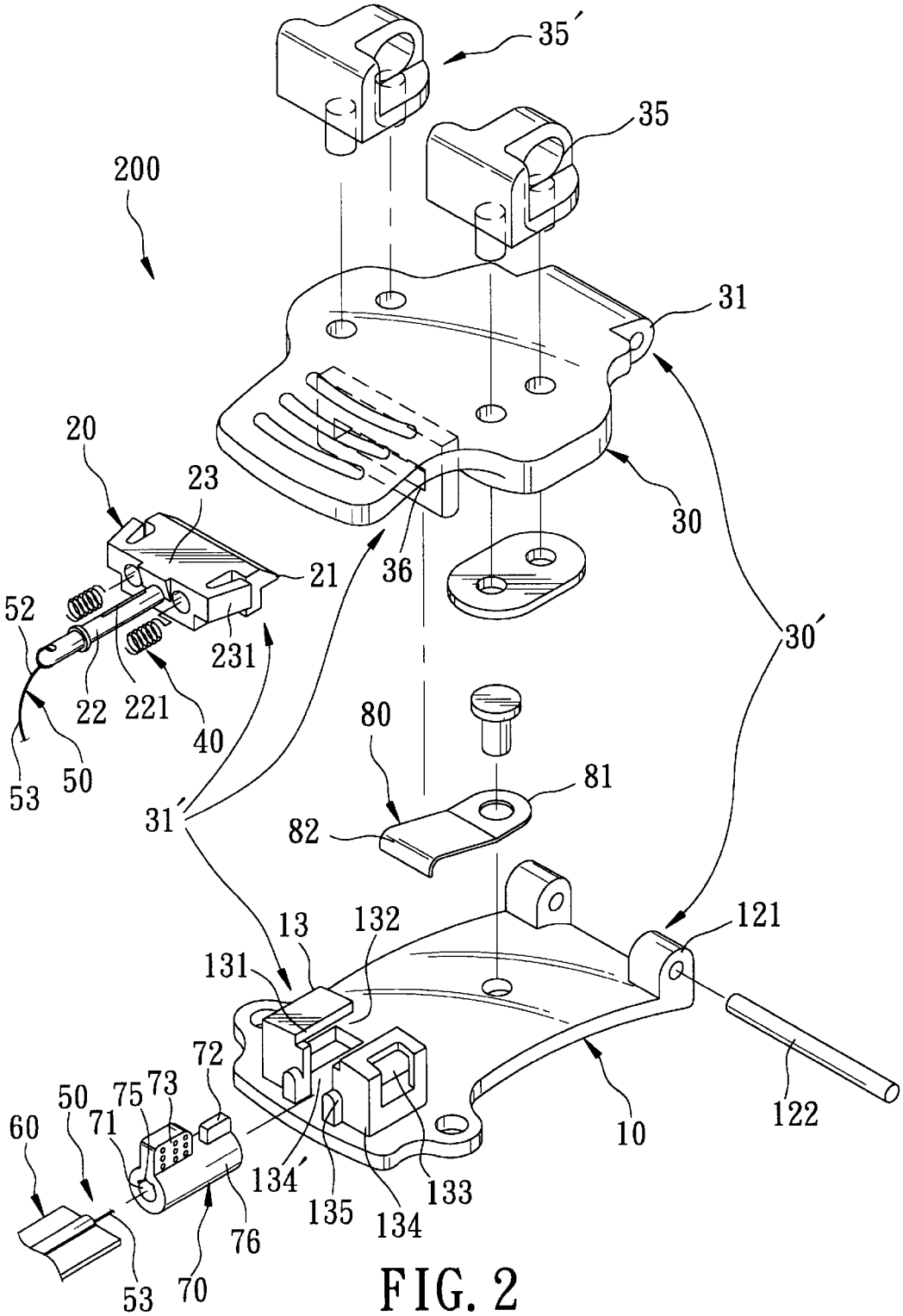
FIG. 2 is an exploded perspective view showing an anchoring assembly of the first preferred embodiment.

Referring to FIGS. 1 and 2, the footwear 100 according to this invention is shown to be embodied in a shoe that includes a sole 110, an upper 120, a closure member 300, and an anchoring assembly 200.

The upper 120 is connected to the sole 110 and has a toe portion 121 and a heel portion 122. The upper 120 is formed with an opening 170 adjacent to the heel portion 122 to permit slipping of a foot into the upper 120. The upper 120 further has a tongue 123 that is connected to the toe portion 121 and that extends in a longitudinal direction, and first and second closure tabs 190, 180 that are spaced apart from each other in a transverse direction transverse to the longitudinal direction and that are disposed to overlap opposite lateral sides of the tongue 123, respectively. The first closure tab 190 is provided with a plurality of eyelets 190". The second closure tab 180 includes a first tab portion 181 proximate to the toe portion 121, a second tab portion 182 proximate to the opening 170, and an intermediate eyelet-free tab portion 180' between the first and second tab portions 181, 182. The first tab portion 181 is provided with a plurality of eyelets 180", and the second tab portion 182 is provided with one eyelet 180".

The closure member 300 is provided on the upper 120, extends between the first and second closure tabs 190, 180, and is connected to the first and second closure tabs 190, 180. The closure member 300 is movable from a loosening state (see FIG. 9), where the closure member 300 allows limited movement of the first and second closure tabs 190, 180 away from each other, to a tightened state (see FIG. 1), where the closure member 300 pulls the first and second closure tabs 190, 180 toward each other to tighten the shoe around the foot.

The anchoring assembly 200 includes a stationary member 10, a movable member 30, a pivot unit 30', a releasable fastener unit 31', a locking member 70, a pull string unit 50, and a biasing member 80.

The stationary member 10 is a curved rectangular member and is mounted securely on the intermediate eyelet-free tab portion 180' of the second closure tab 180 in a well-known manner, such as by riveting. The movable member 30 has a curvature corresponding to that of the stationary member 10, is connected to the closure member 300, and has a footwear lace stringing section 35' formed with a pair of eyelet units 35 spaced apart from each other in the longitudinal direction and fixed on the movable member 30 in a well-known manner, such as by riveting. The space between the pair of eyelet units 35 is equal to that between the corresponding eyelets 190" of the first closure tab 190. The closure member 300 includes a footwear lace 310 strung through the eyelets 190" of the first closure tab 190, the eyelets 180" of the second closure tab 180 and the eyelets 35 of the footwear lace stringing section 35' of the movable member 30 to form a crisscross pattern between the first and second closure tabs 190, 180.

Figure 9:
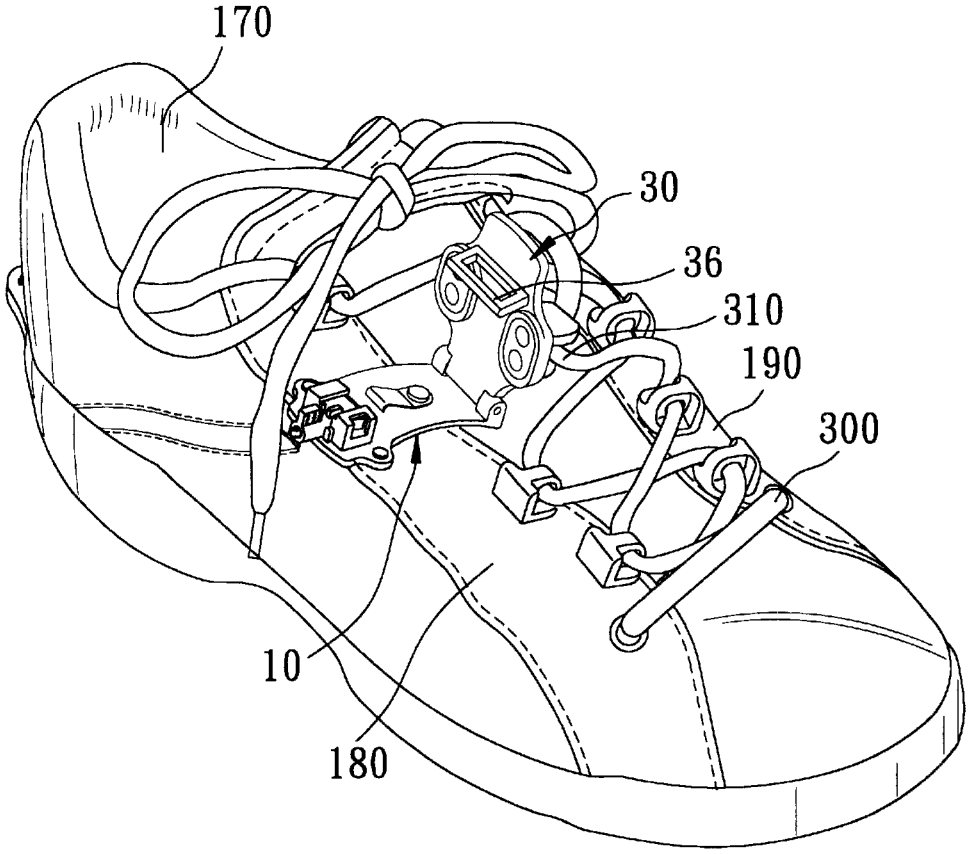
FIG. 9 is a perspective view of the first preferred embodiment of a footwear according to this invention in a loosened state.

The pivot unit 30' is provided on the stationary and movable members 10, 30 proximate to the tongue 123 of the upper 120 to permit pivoting movement of the movable member 30 relative to the stationary member 10 about a pivot axis that extends in the longitudinal direction between a footwear tightening position as shown in FIG. 1, in which the movable member 30 is turned toward the stationary member 10 so as to be superimposed on the stationary member 10 and move the closure member 300 to the tightened state, and a footwear loosening position as shown in FIG. 9, in which the movable member 30 is turned away from the stationary member 10 so as to move the closure member 300 to the loosening state.

Figure 3:
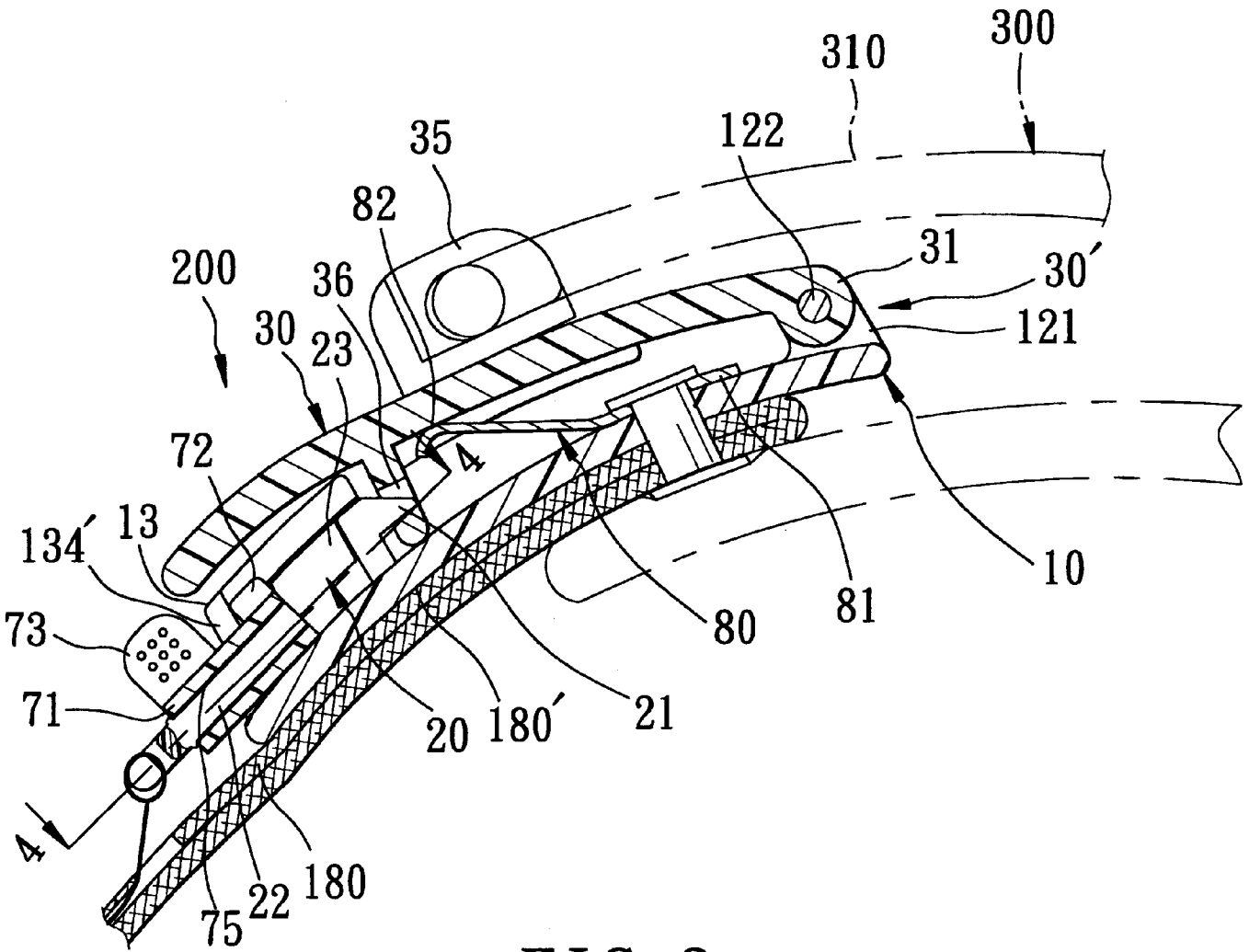
FIG. 3 is a fragmentary sectional view of the first preferred embodiment, showing how the anchoring assembly retains the closure member in the tightened state.

Referring to FIGS. 2 and 3, the pivot unit 30' includes a pair of upright pivot lugs 121 formed on the stationary member 10, a pivot ear 31 formed on the movable member 30 and disposed between the pivot lugs 121, and a pivot pin 122 that extends in the longitudinal direction and that couples pivotally the pivot ear 31 to the pivot lugs 121.

The biasing member 80 is disposed between the stationary and movable members 10, 30, and provides a biasing force to bias the movable member 30 away from the footwear tightening position. The biasing member 80 is made of a resilient material, such as a metal sheet, and includes a biasing end 82 and a fixing end 81 fixed to the stationary member 10 in a well known manner, such as by riveting.

The releasable fastener unit 31' is provided on the stationary and movable members 10, 30 for releasably retaining the movable member 30 at the footwear tightening position. The releasable fastener unit 31' includes a positioning member 13 provided on the stationary member 10, a first fastener member 20 mounted to the positioning member 13 and movable in the transverse direction, a second fastener member 36 provided on the movable member 30 and fastened releasably to the first fastener member 20, and a resilient member 40 for urging the first fastener member 20 in the transverse direction away from the positioning member 13.

Figure 4:
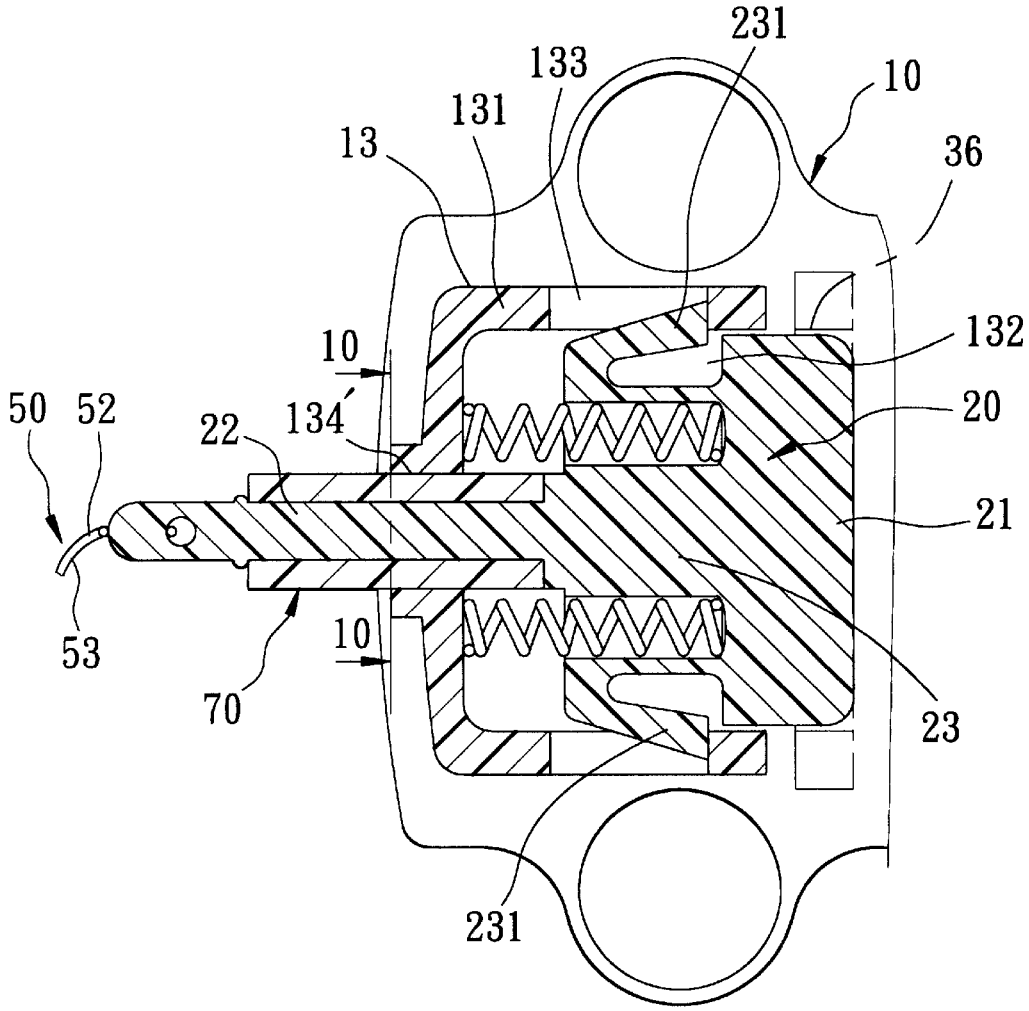
FIG. 4 is a fragmentary sectional view taken along line 4—4 of FIG. 3.
Figure 6:
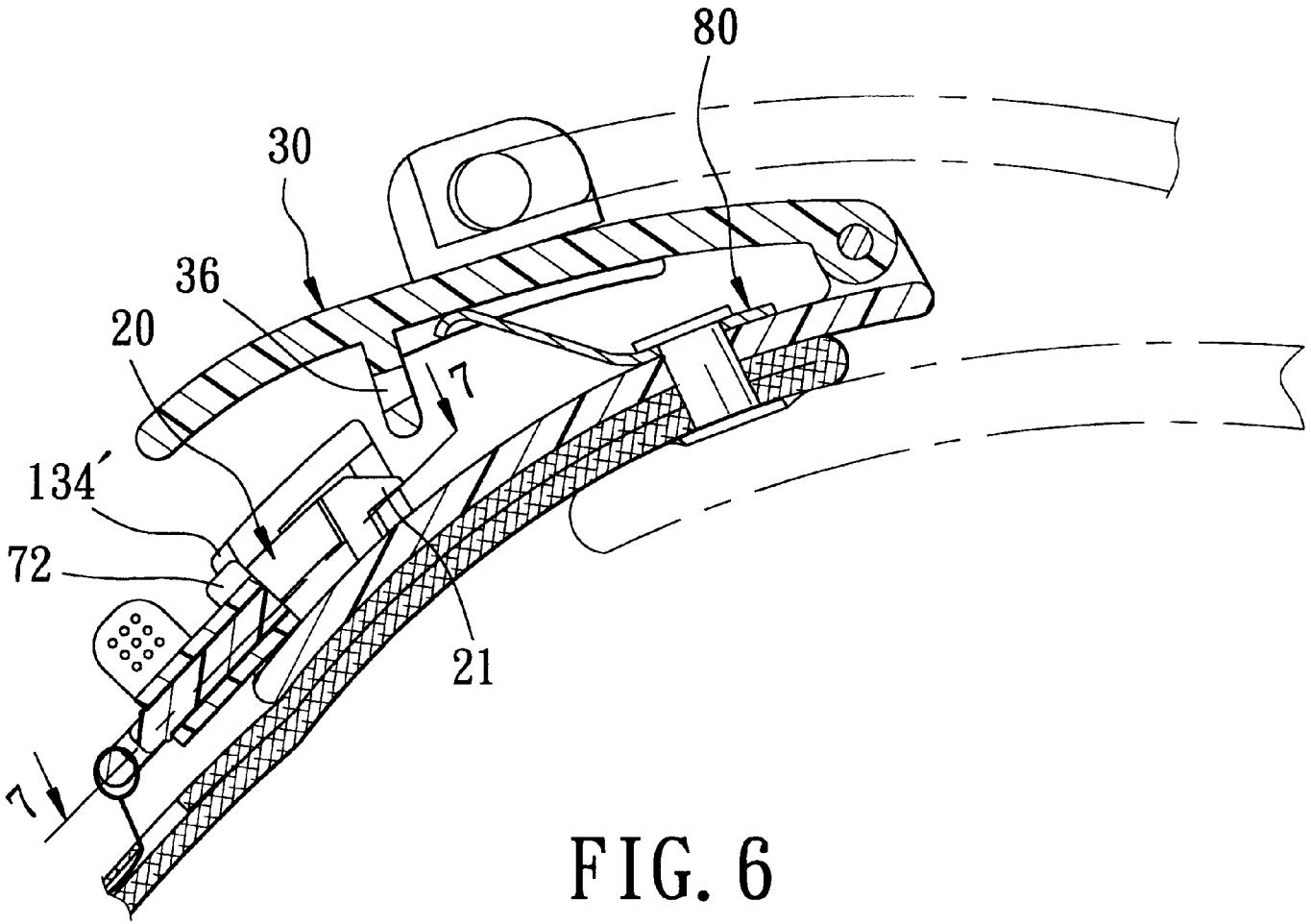
FIG. 6 is a fragmentary sectional view of the first preferred embodiment, showing how the anchoring assembly is operated to loosen the closure member.
Figure 7:
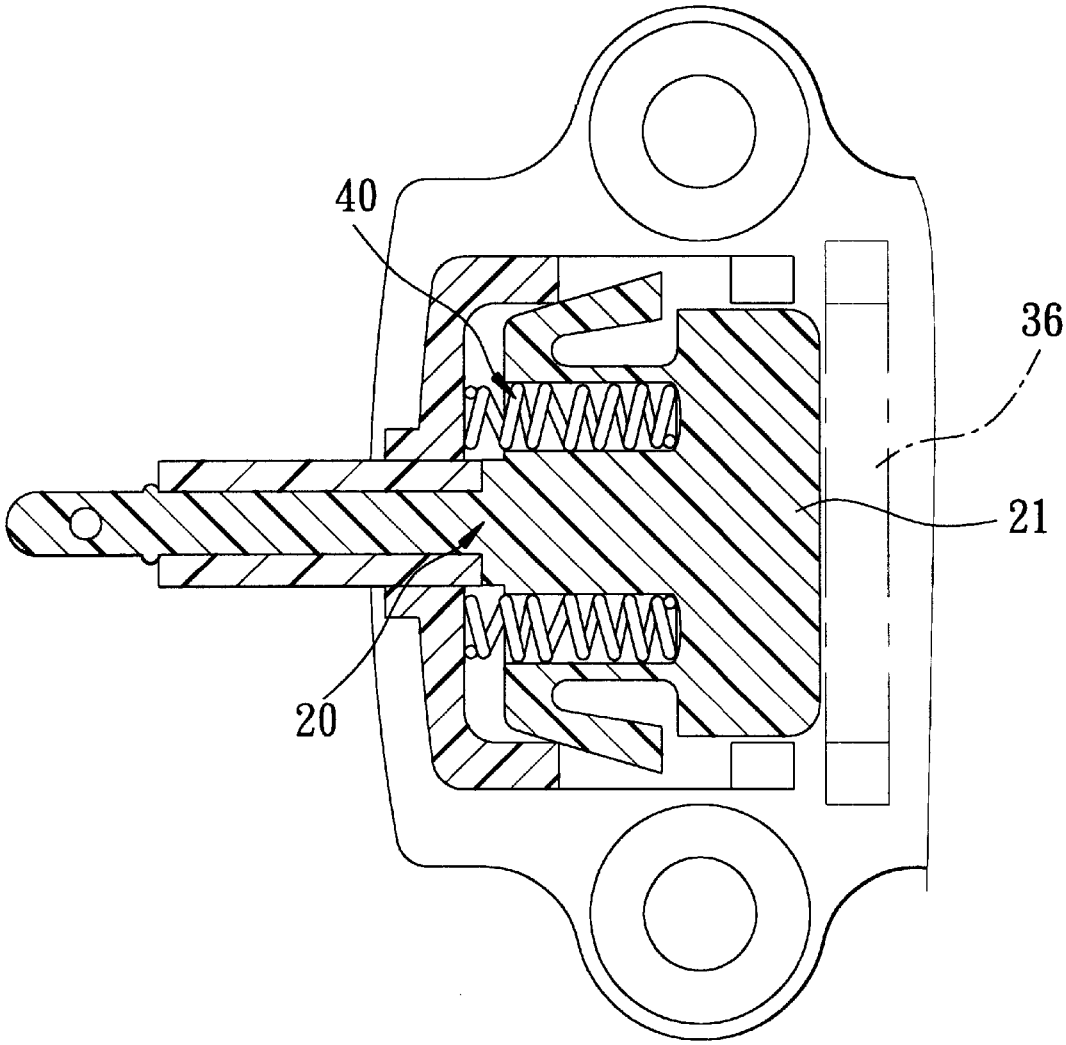
FIG. 7 is a fragmentary sectional view taken along line 7—7 of FIG. 6.

The first fastener member 20 is movable relative to the second fastener member 36 between an engaging position as shown in FIGS. 3 and 4, where the first and second fastener members 20, 36 engage each other to retain the movable member 30 at the footwear tightening position, and a disengaging position as shown in FIGS. 6 and 7, where the first and second fastener members 20, 36 disengage from each other to permit movement of the movable member 30 to the footwear loosening position.

Referring again to FIGS. 2 and 4, the first fastener member 20 includes a tapered fastening portion 21 fastened releasably to the second fastener member 36, and a rod-shaped pulling portion 22 opposite to the fastening portion 21 in the transverse direction. The second fastener member 36 is formed as a plate with an engaging hole for engaging the fastening portion 21 of the first fastener member 20.

The positioning member 13 includes a hollow body 131 defining a space that extends in the transverse direction for receiving the first fastener member 20. The hollow body 131 has an open first end 132 that permits extension of the fastening portion 21 of the first fastener member 20 out of the space, and a second end 134 formed with a passage 134' that permits extension of the pulling portion 22 of the first fastener member 20 out of the space. Two blocks 135 are respectively disposed on opposite lateral edges of the passage 134' at an outer side of the second end 134 of the hollow body 131.

Furthermore, the hollow body 131 is formed with a pair of opposite elongate slots 133 that extend in the transverse direction. The first fastener member 20 has a sliding portion 23 between the pulling and fastening portions 22, 21 and formed with two resilient tabs 231, each of which extends into a corresponding one of the slots 133 to limit movement of the first fastener member 20 relative to the positioning member 13. The resilient member 40 includes a pair of coiled compression springs having opposite ends that abut against the sliding portion 23 and the second end 134 of the hollow body 131, respectively.

Figure 10:
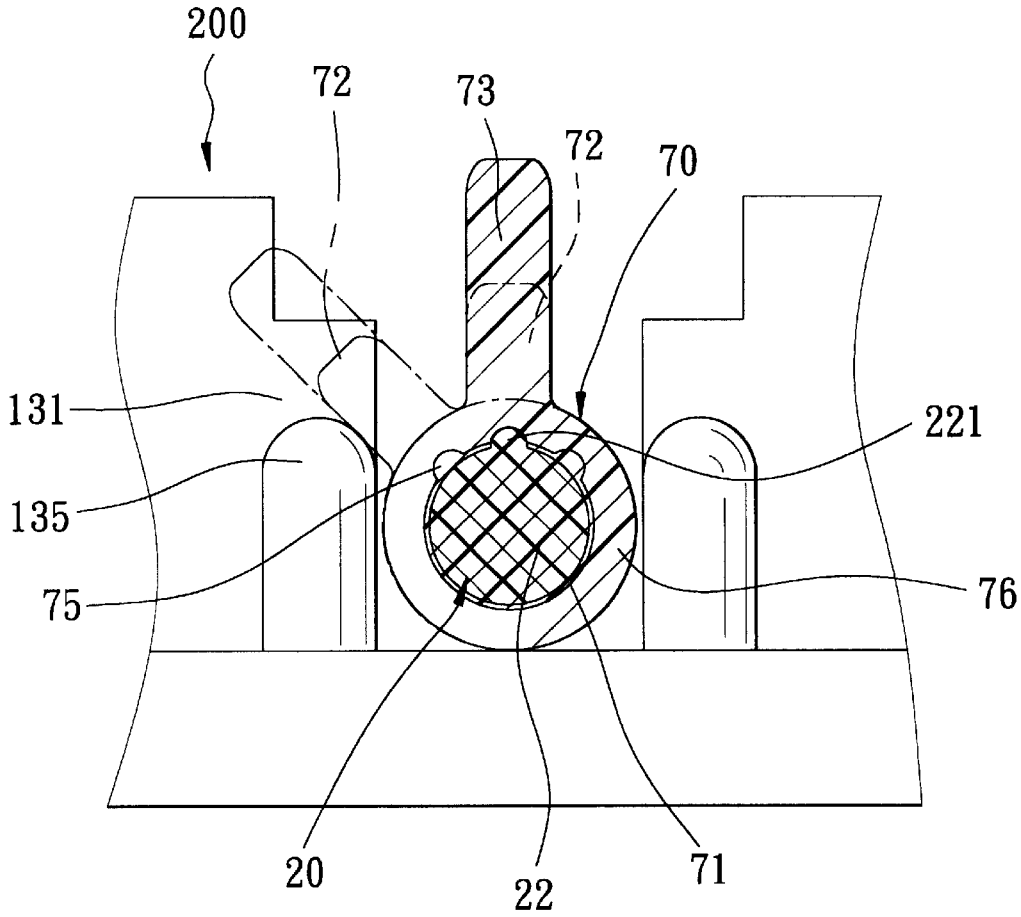
FIG. 10 is a fragmentary sectional view taken along line 10—10 of FIG. 4.

Referring again to FIG. 2, the locking member 70 has a tubular portion 76 sleeved rotatably on the pulling portion 22 of the first fastener member 20. The tubular portion 76 is formed with a radial stop block 72 and an operating block 73 spaced apart from the radial stop block 72 along the length of the tubular portion 76. With further reference to FIG. 10, the passage 134' has a section that permits movement of the stop block 72 in and out of the space defined by the hollow body 131 when the stop block 72 is registered with the section. The tubular portion 76 is rotatable to misalign the stop block 72 and the section of the passage 134' such that the stop block 72 can engage the second end 134 of the hollow body 131 and prevent movement of the first fastener member 20 relative to the positioning member 13 in a direction for disengaging from the second fastener member 36 when the stop block 72 is disposed in the space defined by the hollow body 131.

Furthermore, as best shown in FIG. 10, the pulling portion 22 is formed with a friction rib 221 that extends in the transverse direction. The tubular portion 76 is formed with a set of grooves 75 within an inner wall surface 71 of the tubular portion 76. The grooves 75 extend in the transverse direction to selectively and removably engage the friction rib 221.

Figure 5:
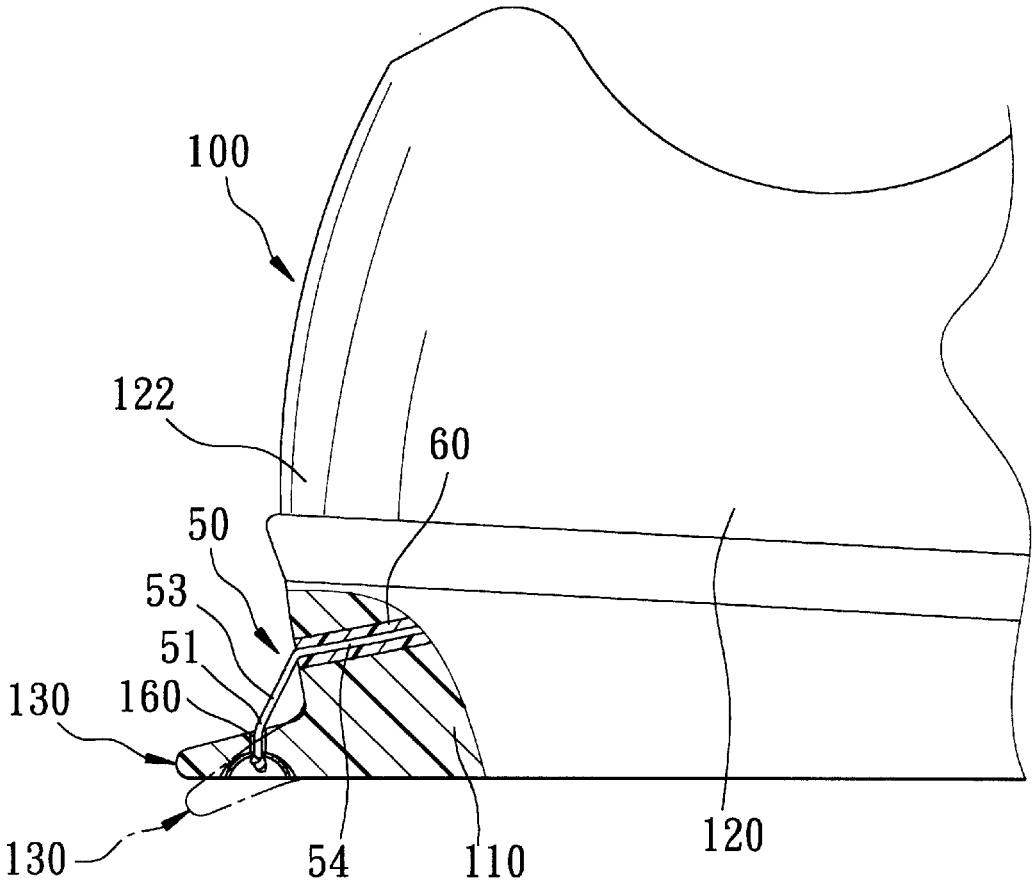
FIG. 5 is a partly sectional fragmentary schematic view of the first preferred embodiment, showing a pull string unit of the anchoring assembly.

Referring to FIGS. 4 and 5, a pull string unit 50 is coupled to the pulling portion 22 of the first fastener member 20 and is operable so as to move the first fastener member 20 to the disengaging position. The pull string unit 50 includes a resilient operating portion 130, a string 53, and a guiding tube 60. The resilient operating portion 130 protrudes laterally from the sole 110 adjacent to the heel portion 122 of the upper 120. The string 53 has a knotted first connecting portion 51 anchored to the resilient operating portion 130 at an anchoring hole 160 in the latter, a second connecting portion 52 connected to the pulling portion 22 of the first fastener member 20, and an intermediate portion 54 between the first and second connecting portions 51, 52. The guiding tube 60 is mounted on the upper 120 (see FIG. 1) to permit extension of the intermediate portion 54 of the string 53 therethrough.

Figure 8:
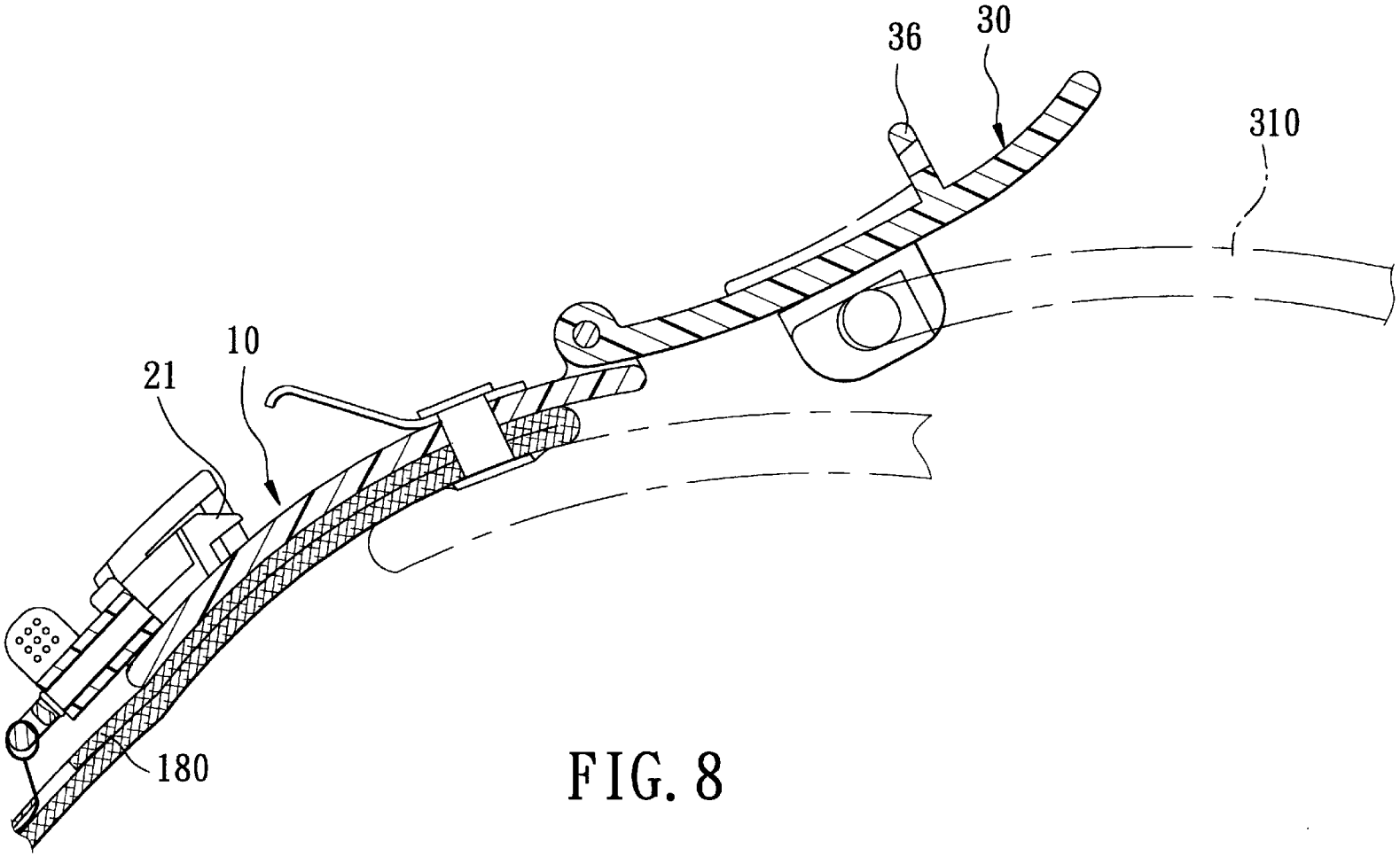
FIG. 8 is a fragmentary sectional view of the first preferred embodiment, showing the anchoring assembly when the closure member is moved to a loosening state.

Referring again to FIG. 5, when the wearer desires to take off the footwear, the resilient operating portion 130 is flexed downward to pull the string 50 so that the fastening portion 21 of the first fastener member 20 is released from the second fastener member 36. Due to the biasing action of the biasing member 80, the movable member 30 moves away from the footwear tightening position, as shown in FIGS. 6 and 7. Thereafter, as shown in FIGS. 8 and 9, the movable member 30 can be turned to the footwear loosening position such that the footwear can be taken off quickly and easily. Alternatively, the fastening portion 21 of the first fastener member 20 can be released from the second fastener member 36 by directly pulling the operating block 73 of the locking member 70 in the transverse direction to move the first fastener member 20 away from the second fastener member 36.

Figure 11:
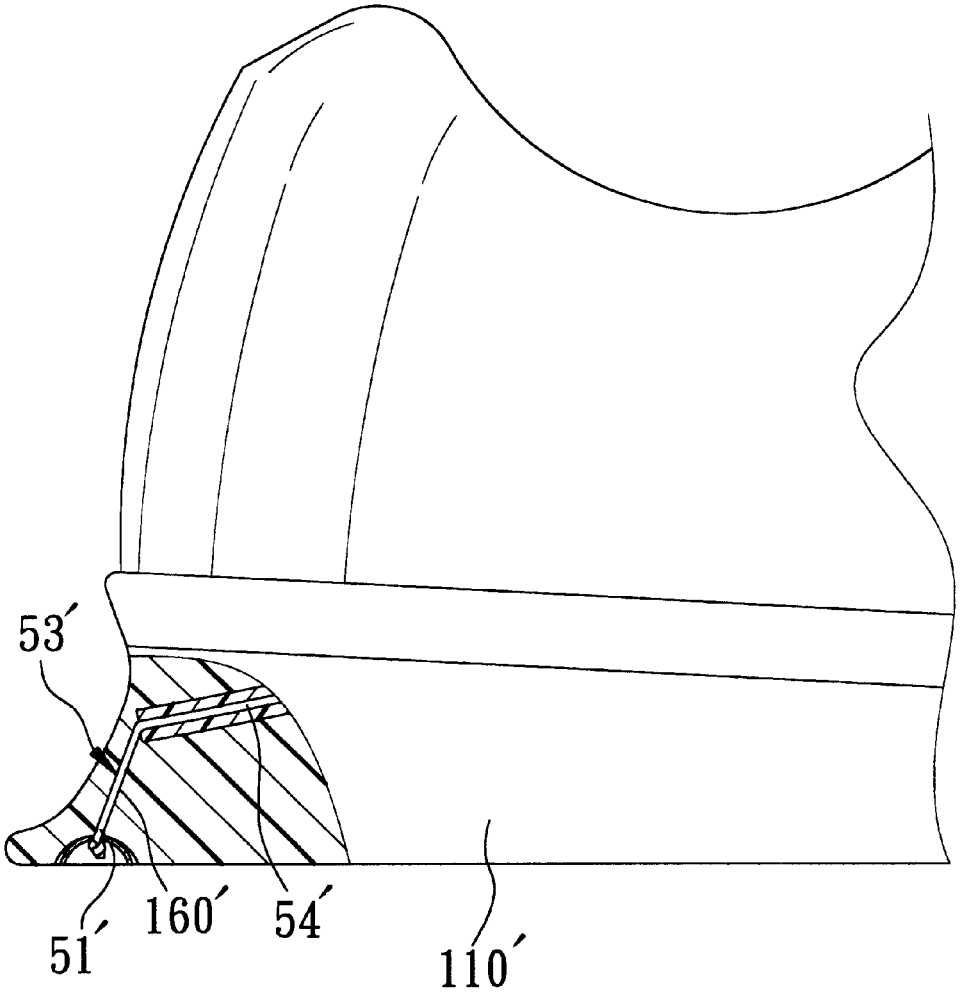
FIG. 11 is a partly sectional fragmentary schematic view showing a pull string unit of the second preferred embodiment of a footwear according to this invention.

Referring to FIG. 11, in the second preferred embodiment of the footwear according to this invention, the sole 110' is formed with a bore 160' to conceal a section of the string 53' between the intermediate portion 54' and the knotted first connecting portion 51'.

Figure 12:
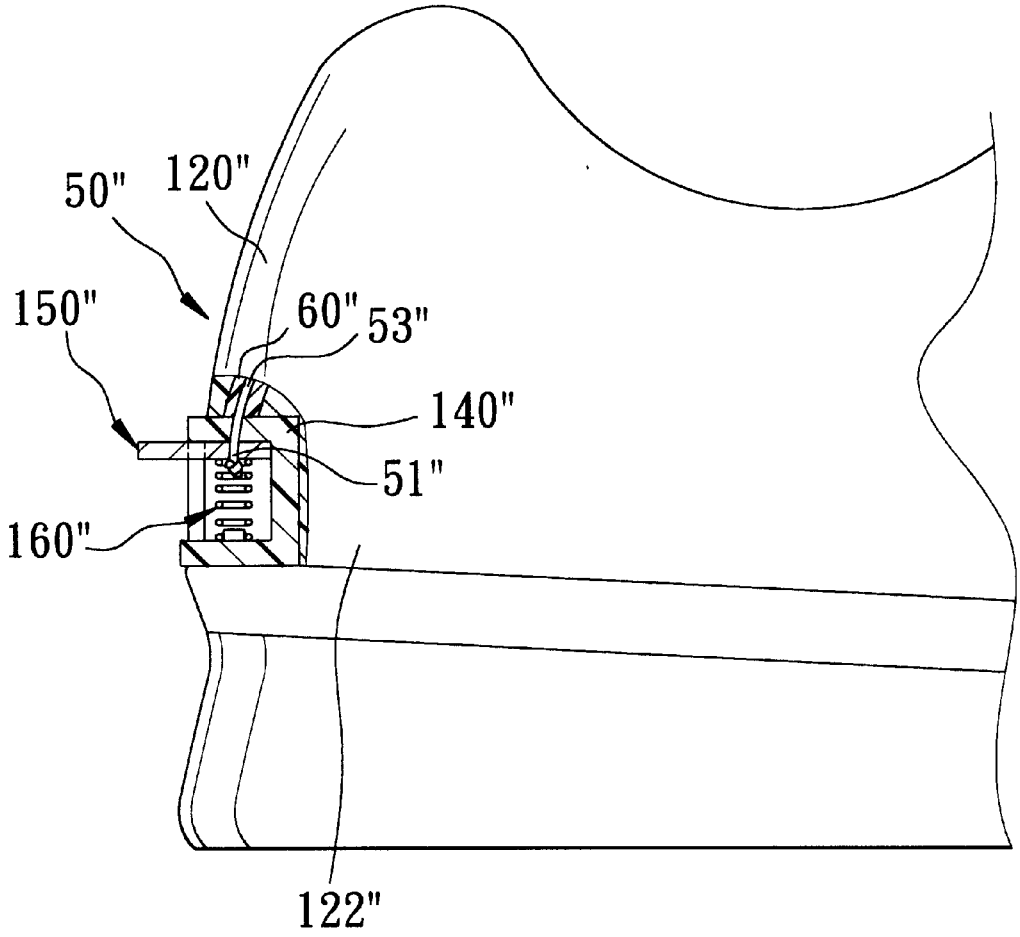
FIG. 12 is a partly sectional fragmentary schematic view showing a pull string unit of the third preferred embodiment of a footwear according to this invention.

Referring to FIG. 12, in the third preferred embodiment of the footwear according to this invention, the pull string unit 50" includes a frame 140", an operating plate 150", a string 53", a resilient member 160", and a guiding tube 60". The frame 140" is mounted on the heel portion 122" of the upper 120". The operating plate 150" is mounted movably in the frame 140" and is movable between pulling and relieving positions. The string 53" has a knotted first connecting portion 51" anchored to the operating plate 150", a second connecting portion (not shown in FIG. 12) connected to the pulling portion of the first fastener member (not shown in FIG. 12), and an intermediate portion between the first and second connecting portions. The resilient member 160" is received within the frame 140" for biasing the operating plate 150" to the relieving position. The guiding tube 60" is mounted on the upper 120 to permit extension of the intermediate portion of the string 53" therethrough.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A footwear comprising:

a sole;

an upper connected to said sole and having a toe portion and a heel portion, said upper being formed with an opening adjacent to said heel portion to permit slipping of a foot into said upper, said upper further having a tongue that is connected to said toe portion and that extends in a longitudinal direction, and first and second closure tabs that are spaced apart from each other in a transverse direction transverse to the longitudinal direction and that are disposed to overlap opposite lateral sides of said tongue, respectively;

a closure member provided on said upper, extending between said first and second closure tabs, and connected to at least one of said first and second closure tabs, said closure member being movable from a loosening state, where said closure member allows limited movement of said first and second closure tabs away from each other, to a tightened state, where said closure member pulls said first and second closure tabs toward each other to tighten said shoe around the foot; and an anchoring assembly including a stationary member mounted securely on said second closure tab, a movable member connected to said closure member and movable relative to said stationary member between a footwear tightening position, in which said closure member is moved to the tightened state, and a footwear loosening position, in which said closure member is moved to the loosening state, and a releasable fastener unit, provided on said stationary and movable members, for releasably retaining said movable member at said footwear tightening position, said releasable fastener unit including a positioning member provided on said stationary member, a first fastener member mounted movably on said positioning member, a second fastener member provided on said movable member and fastened releasably to said first fastener member, and a resilient member for urging said first fastener member away from said positioning member, said first fastener member being movable relative to said second fastener member between an engaging position, where said first and second fastener members engage each other to retain said movable member at said foot wear tightening position, and a disengaging position, where said first and second fastener members disengage from each other to permit movement of said movable member to said footwear loosening position;

said first fastener member including a fastening portion fastened releasably to said second fastener member, and a pulling portion opposite to said fastening portion;

said anchoring assembly further including a pull string unit, said pull string unit including a string coupled to said pulling portion of said first fastener member and one of said sole and said upper, said string being operable so as to move said first fastener member to the disengaging position.

2. The footwear as claimed in claim 1, wherein said second fastener member is formed as a plate with an engaging hole for engaging said fastening portion of said first fastener member.

3. The footwear as claimed in claim 1, wherein said positioning member includes a hollow body defining a space that extends in the transverse direction for receiving said first fastener member, said hollow body having an open first end that permits extension of said fastening portion of said first fastener member out of said space, and a second end formed with a passage that permits extension of said pulling portion of said first fastener member out of said space.

4. The footwear as claimed in claim 3, wherein said hollow body is formed with an elongate slot that extends in the transverse direction, said first fastener member having a sliding portion between said pulling and fastening portions and formed with a tab that extends into said elongate slot to limit movement of said first fastener member relative to said positioning member.

5. The footwear as claimed in claim 3, wherein said first fastener member has a sliding portion between said pulling and fastening portions, said resilient member including a coiled compression spring having opposite ends that abut against said sliding portion and said second end of said hollow body, respectively.

6. The footwear as claimed in claim 3, wherein said anchoring assembly further includes a locking member having a tubular portion sleeved rotatably on said pulling portion of said first fastener member, said tubular portion being formed with a radial stop block, said passage having a section that permits movement of said stop block in and out of said space when said stop block is registered with said section, said tubular portion being rotatable to misalign said stop block and said section of said passage such that said stop block can engage said second end of said hollow body when said stop block is disposed in said space.

7. The footwear as claimed in claim 6, wherein said pulling portion is formed with a friction rib that extends in the transverse direction, and said tubular portion is formed with a set of grooves that extend in the transverse direction to selectively and removably engage said friction rib.

8. The footwear as claimed in claim 1, wherein said pull string unit includes:

a resilient operating portion protruding laterally from said sole adjacent to said heel portion of said upper;

said string having a first connecting portion anchored to said resilient operating portion, a second connecting portion connected to said pulling portion of said first fastener member, and an intermediate portion between said first and second connecting portions; and a guiding tube mounted on said upper to permit extension of said intermediate portion of said string therethrough.

9. The footwear as claimed in claim 8, wherein said sole is formed with a bore to conceal a section of said string between said intermediate portion and said first connecting portion.

10. The footwear as claimed in claim 1, wherein said pull string unit includes:

a frame mounted on said heel portion of said upper;

an operating plate mounted movably in said frame and movable between pulling and relieving positions;

said string having a first connecting portion anchored to said operating plate, a second connecting portion connected to said pulling portion of said first fastener member, and an intermediate portion between said first and second connecting portions;

a resilient member received within said frame for biasing said operating plate to said relieving position; and a guiding tube mounted on said upper to permit extension of said intermediate portion of said string therethrough.

11. The footwear as claimed in claim 1, wherein said anchoring assembly further includes a pivot unit provided on said stationary and movable members proximate to said tongue of said upper to permit pivoting movement of said movable member relative to said stationary member about a pivot axis that extends in the longitudinal direction between said footwear tightening position and said footwear loosening position.

12. The footwear as claimed in claim 11, wherein said pivot unit includes:

a pair of upright pivot lugs formed on said stationary member;

a pivot ear formed on said movable member and disposed between said pivot lugs; and a pivot pin that extends in the longitudinal direction and that couples pivotally said pivot ear to said pivot lugs.

13. The footwear as claimed 12, wherein said anchoring assembly further includes a biasing member which is disposed between said stationary and movable members and which provides a biasing force to bias said movable member away from said footwear tightening position.

14. The footwear as claimed in claim 1, wherein:

said first closure tab is provided with a plurality of eyelets;

said second closure tab including a first tab portion proximate to said toe portion, a second tab portion proximate to said opening, and an intermediate eyelet-free tab portion between said first and second tab portions, each of said first and second tab portions being provided with at least one eyelet;

said stationary member being mounted securely on said intermediate eyelet-free tab portion of said second closure tab;

said movable member further having a footwear lace stringing section formed with at least one eyelet;

said closure member including a footwear lace strung through said eyelets of said first closure tab, said eyelets of said second closure tab and said at least one eyelet of said footwear lace stringing section of said movable member to form a criss-cross pattern between said first and second closure tabs.

15. The footwear as claimed in claim 14, wherein said footwear lace stringing section includes a pair of eyelet units spaced apart from each other in the longitudinal direction and fixed on said movable member.

* * * * *